US005591039A

United States Patent [19]

Matthews

[11] Patent Number: 5,591,039

[45] Date of Patent: Jan. 7, 1997

[54] SOCKET CONTACT WITH ARC ARRESTING MEMBER

[75] Inventor: Russell H. Matthews, Modesto, Calif.

[73] Assignee: Elcon Products International, Fremont, Calif.

[21] Appl. No.: 456,686

[22] Filed: Jun. 1, 1995

[51] Int. Cl.[6] ..... H01R 13/53

[52] U.S. Cl. ..... 439/181; 439/88; 439/86

[58] Field of Search ..... 439/842, 843, 439/851, 852, 856, 857, 860, 862, 181, 183, 86, 88

[56] References Cited

U.S. PATENT DOCUMENTS 3,120,989 2/1964 Solorow et al. ..... 339/256
3,945,699 3/1976 Westrom ..... 439/183
4,451,107 5/1984 Dola et al. ..... 339/143 R
4,749,357 6/1988 Foley ..... 439/80
4,824,380 4/1989 Matthews ..... 439/78
5,088,942 2/1992 Welsh et al. ..... 439/843

*Primary Examiner*—David L. Pirlot
*Assistant Examiner*—Yong Kim
*Attorney, Agent, or Firm*—Burns, Doane, Swecker & Mathis, L.L.P.

[57] ABSTRACT

An electrical socket for mating with a pin contact is provided which has an expansion ring adjacent to the opening into the electrical socket so that when the pin contact is brought into mating relation with the socket, an electrical connection is made between the pin contact and the expansion ring to prevent deleterious arcing to a thin conductive contact element in the socket.

7 Claims, 5 Drawing Sheets

SOCKET CONTACT WITH ARC ARRESTING MEMBER

BACKGROUND OF THE INVENTION

This invention relates to socket contacts for use in electrical connectors and more particularly to socket contacts with a member for protecting against arcing between the related pin contact and the inner portion of the socket contact. Most especially, it relates to such a socket contact in which the inner portion to be protected against arcing is a thin conductive strip.

Socket contacts which are generally tubular in shape have been provided for use in electrical connectors. In general, the socket contact is connected to a voltage source and has an end with a bore therein which is designed to receive the protruding end of a related pin contact. Some socket contacts have an opening with a diameter greater than the diameter of the mating pin to allow entry of the pin therein. These socket contacts often include a thin conductive strip mounted inside, the strip having a raised portion which protrudes into the center of the receiving bore for engaging the contact pin. The strip serves to enhance the electrical connection between the pin and socket contacts.

When an electrical potential exists between the socket and pin contacts, arcing can occur between the contacts as they are brought close together for mating. Any arcing will cease once the socket and pin contacts make physical contact, at which time current passes between the contacts causing the electrical potential difference to dissipate. With socket contacts having conductive strips mounted therein and bore openings which permit passage of the contact pin without the pin contacting the end of the socket contact, arcing can occur between the conductive strip and the contact pin. Such arcing can melt or erode the conductive strip, causing damage thereto and thereby reducing the performance of the socket contact.

Flat contacts have been provided with ends which preclude entry of the mating member without contact occurring between the end of the contact and the mating member. These contacts are generally U-shaped in longitudinal cross-section, having two generally planar side wall portions in juxtaposition with each other for receiving a planar mating member therebetween. Opposed thin conductive elements are mounted on the inner surface of each side wall portion for enhancing the electrical connection. Each planar side wall portion is formed with a bevelled inwardly extending lip which permits the mating member to pass only after contact has occurred and the side wall portions are forcibly separated further by insertion of the mating member. In this manner, arcing damage between the conductive element and the mating member is reduced.

As can be seen from the foregoing, the socket contacts of the prior art which include thin conductive strips mounted therein are susceptible to deleterious electrical arcing and other damage. Flat contacts have been provided which reduce damaging arcing to the conductive elements mounted therein, but these contacts are not interchangeable with socket contacts. The round contacts have attendant problems as well.

SUMMARY OF THE INVENTION

One purpose of the present invention is to prevent electrical arcing damage to the thin conductive element that is inside the socket contact. Another purpose is to provide a socket contact that can be mated with a corresponding pin contact when an electrical potential exists between the two before mating.

To accomplish these purposes, there is provided an arc arresting member located near the opening in the socket. The arc arresting member is expandable and has an opening smaller than the diameter of a mating pin. As the pin is brought close to the opening in the socket, any electrical spark jumps (or arcs) to the arc arresting member where it is absorbed and directed safely through the socket contact housing where it does no harm to the thin conductive element in the socket. As the pin is inserted into the front of the socket contact, it contacts the arc arresting member because the arc arresting member opening is smaller than the diameter of the pin. The arc arresting member expands as the pin is inserted further into the socket contact.

In one aspect of the invention there is provided a socket contact for mating with a pin contact, said socket contact comprising a section for attaching to an electrical component, a tubular section forming a bore for receiving the pin contact, a conductive element around an inner wall of the bore and having a contact portion for contacting the pin contact, and an elastic expansion member located adjacent to a forward opening in the tubular section, the expansion member having an opening smaller than the outer diameter of the pin contact for initially engaging the pin contact and establishing an electrical connection between the pin contact and socket contact, and then expanding resiliently so as to let the pin contact pass therethrough into the bore, whereby the initial engagement and resulting electrical connection between the pin contact and the expansion member precludes deleterious electrical arcing between the pin contact and the conductive element.

In accordance with another embodiment of the present invention there is provided an electrical socket contact for mating with a pin contact in an electrical connector, said socket contact comprising an electrical component-attaching end, a cylindrical section opposite of the electrical component-attaching end having a cavity therethrough for receiving the pin contact and an annular recess positioned adjacent to an opening into the cavity, a generally cylindrical contact element located in the cavity with a segment having a reduced inner diameter for contacting the pin contact, and an arresting member seated in the annular recess, the arc arresting member having a segment with an inner diameter smaller than an outer diameter of the pin contact whereby when the pin contact is inserted through the opening into the cavity an electrical connection is made between the pin contact and the arc arresting member and the arc arresting member is forced to expand by the pin contact as the pin contact is inserted into the cavity of the cylindrical section.

BRIEF DESCRIPTION OF THE DRAWINGS

Many objects and advantages of the present invention will be apparent to those skilled in the art when this specification is read in conjunction with the attached drawings wherein like reference numerals are applied to like elements and wherein.

DETAILED DESCRIPTION OF THE PREFERRED EMBODIMENT

Figure 1:
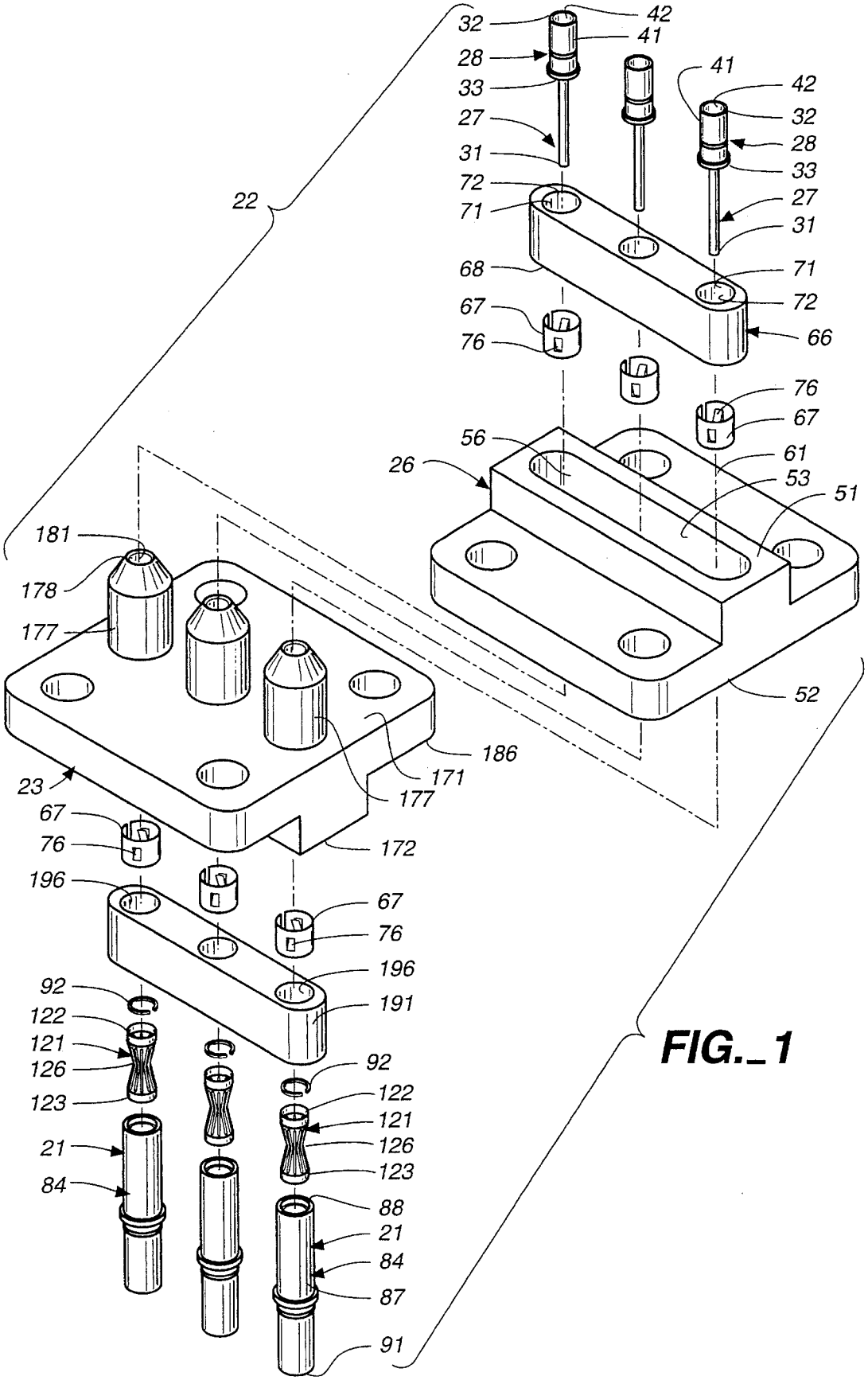
FIG. 1 is an isometric, exploded view of a male connector housing with its attendant pin contacts and a female connector housing with its attendant socket contacts in accordance with one embodiment of the present invention.

In general, a socket contact 21 of the present invention is for use with an electrical connector 22 having a housing formed from a suitable plastic such as polyester (FIG. 1 ). A suitable connector 22 has female and male mating housing portions or sections 23 and 26 which connect together. Socket contact 21 is carried by female housing section 23 and can be connected to a voltage source. A pin contact 27, designed to cooperatively mate with the socket contact, is carried by male housing section 26. Connector 22 shown in the drawings is for use with three socket and pin contacts 21 and 27, but for simplicity only one socket contact and pin contact are illustrated in detail in the drawings and discussed herein. Likewise except for FIG. 6, the housing portions 23 and 26 have been removed from the figures for clarity and simplicity. It should be appreciated that connectors 22 having other configurations and carrying various numbers of socket and pin contacts 21 and 27 are within the scope of the present invention.

Figure 6:
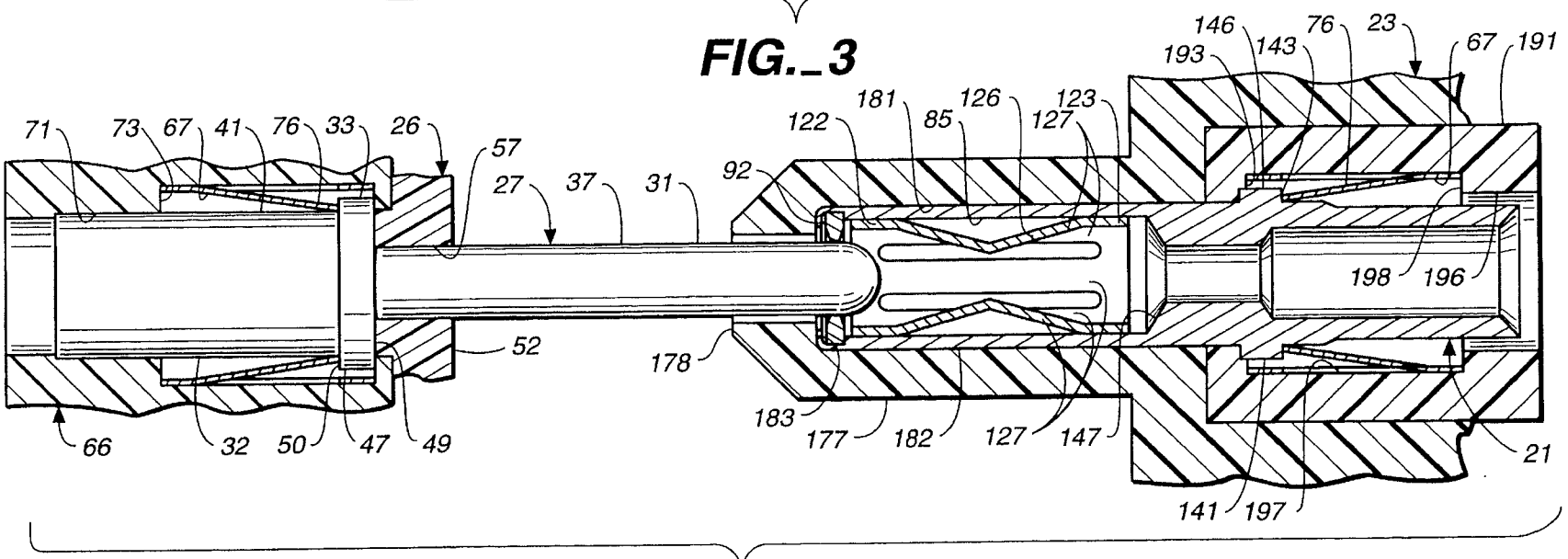
FIG. 6 is a partial sectional view of a pin contact being inserted into a socket contact in accordance with one embodiment of the present invention.

A typical pin contact 27 consists of a conductive body 28 made of a suitable conductive material such as copper or brass and having a circular cross-section. Conductive body 28 has an elongate slender contact pin 31 for mating with socket contact 21, an opposite and axially aligned second or shank portion 32 for relaying the electrical signal beyond connector 22, and a central portion or collar 33 (FIGS. 1 and 6). Solid pin 31, serving as the distal end portion of pin contact 27, is generally circular in cross-section with a pin diameter indicated by dimension 36 in FIG. 6A. Pin 31 has an outer surface 37 and a rounded end 38 which serves as the first end of pin contact 27. Shank portion 32 has an outer surface 41 of greater diameter than pin outer surface 37, an axially centered inner surface 42 which is circular in cross-section and forms a bore for receiving a conductive wire. Outer surfaces 37 and 41 are separated by collar 33 which forms an axially aligned annular stop ring. The ring projects radially outwardly from pin contact 27 beyond outer surface 41. Collar 33 has a seating surface or shoulder 49 which is generally perpendicular to the pin outer surface 37.

Male connector housing section 26 has first and second sides 51 and 52 and is provided with an oblong-shaped cavity 53 formed by inner surface 56 opening onto first side 51. Oblong-shaped cavity 53 includes three circular-shaped bores 57 extending through the oblong-shaped cavity to second side 52. When pin contact 27 is mounted in male housing section 26, shank portion 32 of each pin contact 27 is partially housed in cavity 53 so that the related pin 31 extends through bore 57 and seating surface 49 of contact pin collar 33 is seated against male housing portion 26. Each bore 57 is dimensioned to snugly accommodate the related pin 31. Second side 52 can include a tubular shaped shield (not shown) for each bore 57 and pin 31 extending therethrough for limiting contact by personnel or equipment with pin 31 and pin contact 27. Each shield is typically axially aligned with the related bore 57 and pin 31.

Male housing section 26 can also be provided with flanges 61 for securing to female housing section 23.

Pin contact 27 is retained in male housing section 26 by an elongate locking element 66 and clip ring 67 (FIGS. 1 and 6). Locking element 66 is made from a suitable plastic such as polyester and is configured with an oblong-shaped cross-section and dimensioned so that a portion snaps into and seats within cavity 53. Locking element 66 has a leading end 68 and is provided with three bores 71 extending therethrough and designed to snugly accommodate shank portion 32 within. Each bore 71 is formed by an inner surface 72 which is circular in cross-section and has an annular shoulder 73 formed thereon for supporting a clip ring 67. Each clip ring 67 is formed from a generally circular-shaped metallic strip and has a plurality of inclined barbs 76 protruding radially inwardly toward one end thereof.

Male housing section 26 is assembled by mounting clip ring 67 in bore 71 and inserting pin contact 27 until the ends of barbs 76 are positioned against shoulder 50 of collar 47 and the related end portion of clip ring 67 circumferentially disposed around collar 47. Locking element 66, with pin contact 27 and clip ring 67 mounted therein, is then snapped into cavity 53 of male housing section 26 with pin 31 protruding through bore 57.

Figure 2:
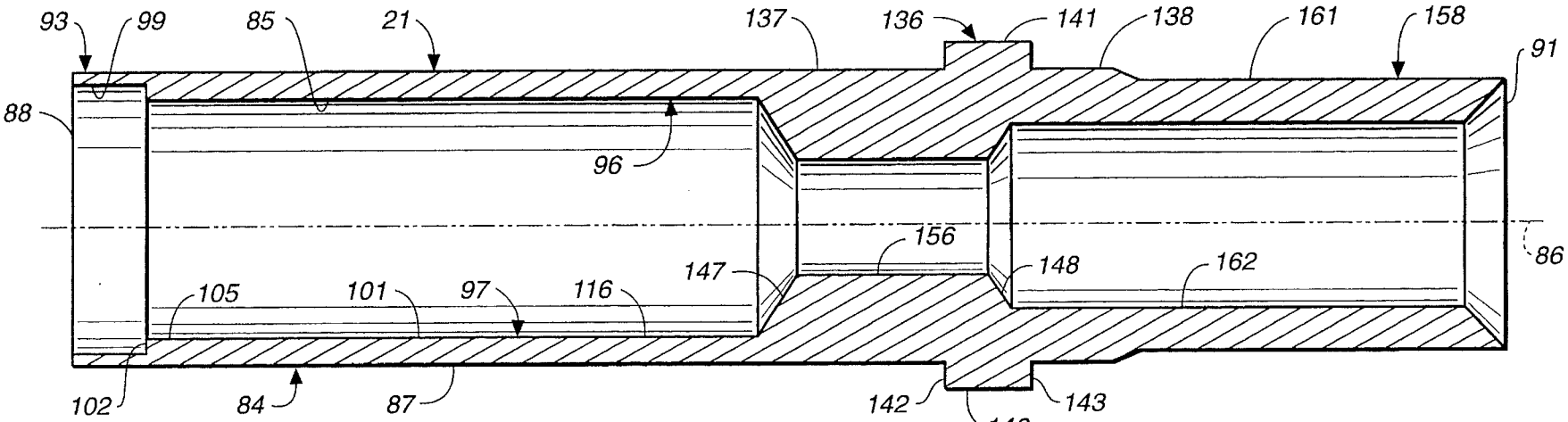
FIG. 2 is a cross-sectional view of a socket body in accordance with one embodiment of the present invention.
Figure 5:
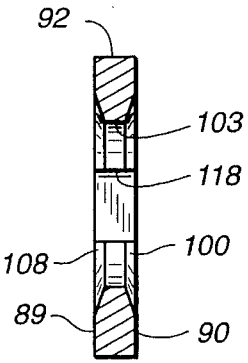
FIG. 5 is a sectional view of the arc arresting member taken along line 5—5 in FIG. 4.
Figure 4:
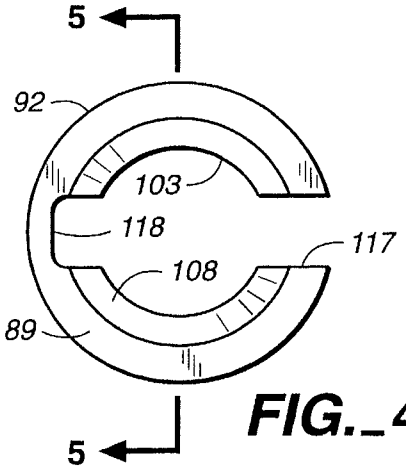
FIG. 4 is a plan view of the arc arresting member shown in FIG. 3.
Figure 3:
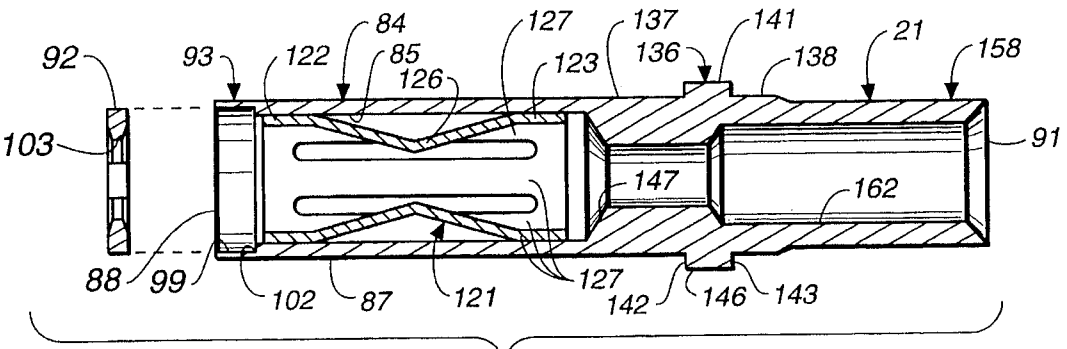
FIG. 3 is a cross-sectional view of the socket body shown in FIG. 2 just prior to assembly with an arc arresting member in accordance with one embodiment of the present invention.

Socket contact 21 includes a receptacle section or hood 84 adapted to receive pin 31. Receptacle section or hood 84 is generally tubular in shape, with a central bore 85 extending therethrough, and is axially centered on a longitudinal axis 86. Hood 84 is made of a suitable conductive material such as copper or brass and has an outer surface 87, which is generally circular in cross-section, and first and second opposite and generally parallel ends 88 and 91. Hood 84 is formed from a first annular end portion or contact portion 93, a second end portion 96 opposite the contact portion and a central portion 97 therebetween (FIG. 2).

Central portion 97 has an inner surface 101 which forms the central portion of bore 85. Surface 101 is generally circular and is coaxial about axis 86 with outer surface 87 of receptacle portion 84.

Hood contact portion 93 extends into bore 85 from inner surface 101 and includes an annular generally planar surface or seat 102 which perpendicularly adjoins with inner surface 99 and extends radially inwardly therefrom to surface 105 of bore 85.

Figure 6A:
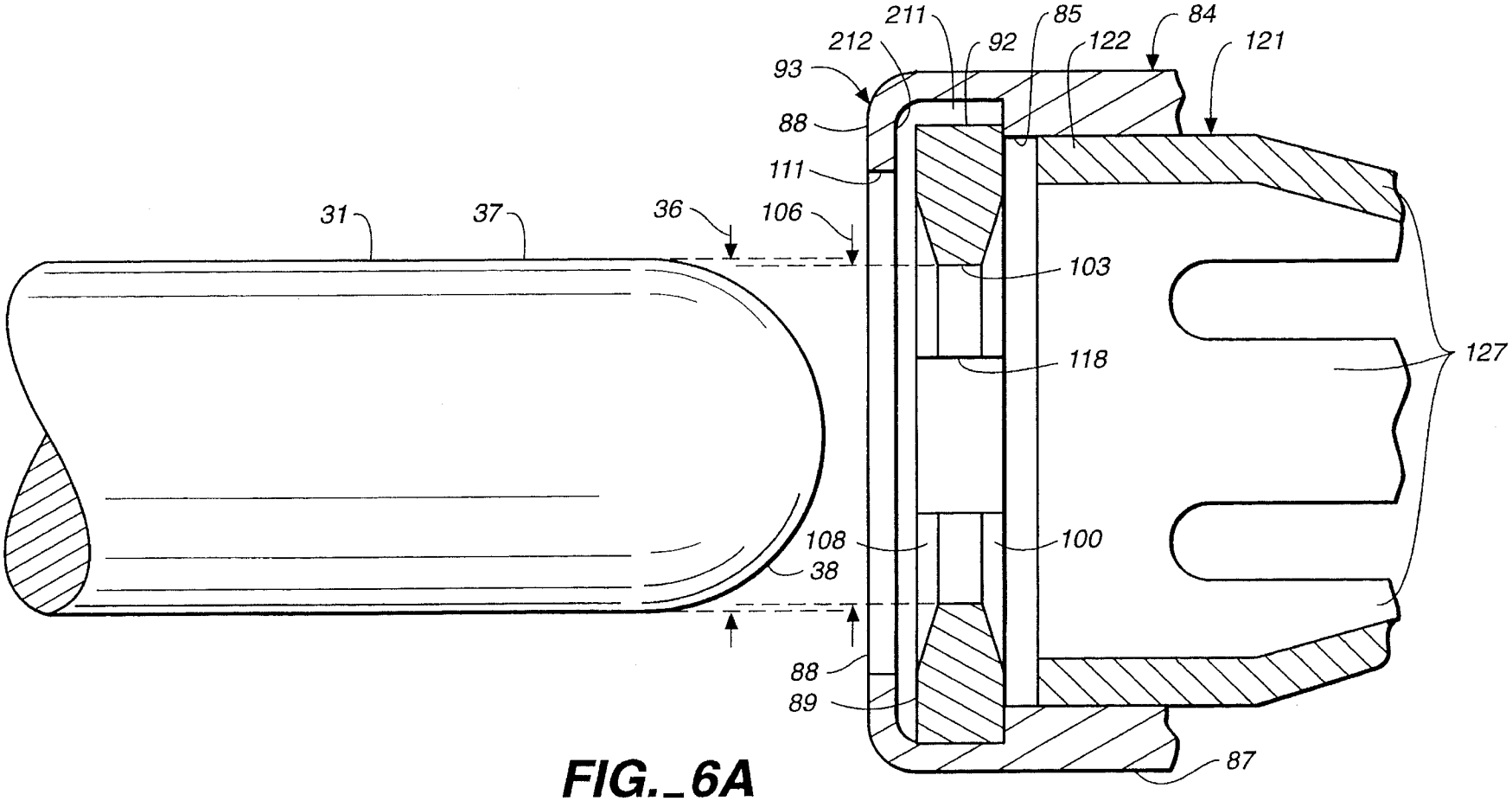
FIG. 6A is a partial sectional view of a pin contact just prior to contact with the arc arresting member in accordance with the present invention.
Figure 7:
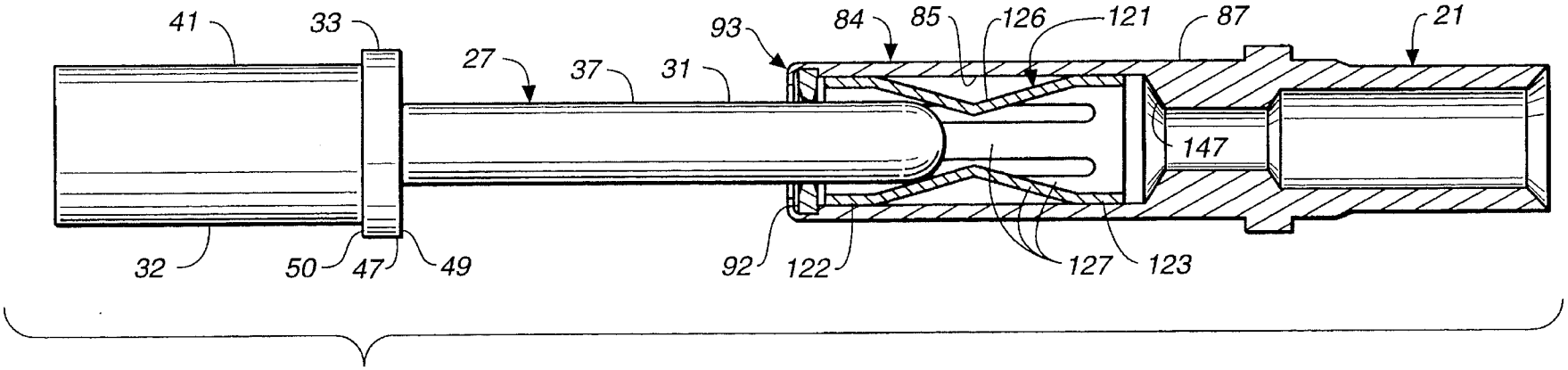
FIG. 7 is a partial sectional view of a pin contact partially inserted in the socket contact.

The arc arresting member is the separate metal ring 92 which floats in cavity 211 in end 88 of socket contact 21 (FIG. 6A). Arc arresting member 92 is split to allow for expansion when pin contact 27 is inserted therethrough. Ring 92 has an inherent spring memory by design, material type and forming methods, which allow repeated insertions and withdrawals of the pin contact without wear or mechanical fatigue of the ring.

Cavity 211 is formed by rolling or pressing over the distal most end of portion 93 after setting ring 92 against seat 102. Seat 102 prevents ring 92 from dislodging toward electrical contact 21. Annular lip 212 and circular opening 111 result from rolling or pressing over the distal most end of portion 93. Lip 212 acts to capture ring 92 and contact 21 in hood 84. Cavity 211 is generally larger than the diameter of ring 92 so as to accommodate the expansion of ring 92 as pin 31 is inserted therethrough.

An inner surface 103, which is generally circular with a diameter indicated by dimension 106, adjoins tapered surface 100 at the radially inner end thereof to bevelled surface 108. More specifically, bevelled surface 108 extends radially outwardly from surface 103 and intersects first side 89 of expansion or arc arresting member 92. Tapered surface 100 intersects second side 90 of expansion member 92. Surface 103 is coaxial with axis 86 and opening 111 to bore 85.

Arc arresting member 92 includes expansion means for permitting opening 103 to expand radially outwardly to a larger diameter for permitting pin 31 to pass therethrough into bore 85. In one embodiment, this expansion means includes opening or split 117 and groove or notch 118. In operation, reduced end 38 of pin 31 initially contacts bevelled surface 108. Reduced end 38 acts against surface 108 to force inside diameter 103 open. Split 117 allows ring 92 to open wider. The material removed from groove 118 creates an elastic area in the ring that allows the ring to open farther as surface 37 comes in contact with surface 103 as pin 31 is inserted farther into hood 84. It is contemplated that the expansion means could take many forms, such as a closed ring that is elastic because of the properties of the material it is made of, or an annular garter spring, or even be attached to hood 84.

Second end portion 96 has an inner surface 116 which is generally circular and forms a portion of bore 85. Surface 116 is coaxial about axis 86 with central portion inner surface 101 and forward portion inner surface 105.

A thin conductive element in the form of conductive strip or "crown" band 121 made from a beryllium-copper alloy or any other suitable material is mounted substantially around inner surfaces 105, 101 and 116 of hood 84. Conductive strip 121 is generally tubular in shape and has a first end portion or engagement portion 122 adjacent annular surface 105 and an opposite second end portion or engagement portion 123. Engagement portions 122 and 123 serve as mounting means or mounting conductive strip 121 within hood 84 and are each generally dimensioned to spring fit therein. Conductive strip 121 has a central contact portion 126 between and raised above engagement portions 122 and 123 for contacting pin 31. Conductive strip contact portion 126 is formed from a plurality of spaced apart cross members 127 which are longitudinally aligned with axis 86 for contacting pin 31. Each cross member 127 is joined at opposite ends to engagement portions 122 and 123 and, when viewed in longitudinal cross-section, has an arcuate shape which extends radially inwardly toward the center thereof.

In another embodiment, hood 84 is slit in at least one location or in at least two locations opposite of each other, in effect creating cantilevered arms. Of necessity, the material used is of spring quality. In this embodiment, the inner surface of hood 84 is slightly smaller than the diameter 36 of pin contact 27 such that when the pin contact is inserted into hood 84, the pin and inner surface form an electrical connection. Alternatively, a conductive strip as described above can be located in a split hood to ensure better electrical performance. The split in the hood of this embodiment permits expansion of the hood to accommodate pin 31 being inserted therein.

Socket contact 21 further includes a generally cylindrical middle section 136 which is integrally formed with hood 84. Middle section 136 is centered about axis 86 and has a first end portion 137, a second opposite end portion or shank portion 138 and a central portion with annular stop ring or collar 141 therebetween. Collar 141 is formed from first or seating and second or trailing spaced apart generally parallel surfaces 142 and 143 which extend radially outwardly from axis 86 toward an outer surface 146 which interconnects surfaces 142 and 143 and is generally circular (FIG. 2).

First end portion 137 is generally tubular in shape and has a first bore 156 which connects with bore 85 through tapered portion 147 of second end portion 96. Bore 156 is generally centered on axis 86 and ends by connecting to tapered portion 148 leading to second bore 162.

Shank portion 138 tapers to circular-shaped outer surface 161. End portion 158 is generally tubular in shape and has a second bore 162 which extends through end 158. Second bore 162 is generally centered on axis 86 and is connected to first bore 156 by tapered portion 148.

First connector housing section 23 is similar in many respects to second connector housing section 26 and has first and second sides 171 and 172. Second side 172 is provided with an oblong-shaped cavity (not shown). Unlike second housing section 26, however, first side 171 of the first connector housing section 23 includes a receptacle, in the form of hollow tubular shaped casing 177, for housing each socket contact 21 used therewith (FIGS. 1 and 6). More specifically, each casing 177 includes a relatively planar outer end surface 178 which serves as a mating surface and is provided with a bore 181 which opens at one end on casing end surface 178 and extends into first housing connector section 23. Bore 181 is formed by a generally circular-shaped inner surface 182 and a ridge 183 which protrudes radially inwardly around the opening of the bore and forms part of outer end surface 178. First housing connector section 23 can also have a plurality of flanges 186 for securing it to second housing connector section 26 by bolting, clamping or otherwise interconnecting each flange 186 with a related flange 61 on second section 26. However, the housing connectors do not have to be bolted or clamped together.

Socket contact 21 is retained in first connector housing section 23 by an elongate locking element 191 and clip ring 67 substantially identical to locking element 66 and clip ring 67. Locking element 191 is configured with an oblong-shaped cross-section and is dimensioned so that a portion snaps within the oblong cavity previously described but not shown. Locking element 191 is provided with bores 196 therethrough. Each bore 196 is designed to accommodate end portion 158 and is formed by a generally circular-shaped inner surface 197 having an annular shoulder 198. Clip ring 67 has a plurality of barbs 76 thereon which protrude radially inwardly toward one end thereof, and is supported in locking element 191 by annular shoulder 198.

Female housing section 23 is assembled by mounting clip ring 67 in bore 196 and inserting socket contact 21 therethrough until the ends of barbs 76 are positioned against trailing surface 143 of collar 141 and the related end portion of clip ring 67 is circumferentially positioned around collar 141 in juxtaposition with annular ring outer surface 146. End portion 158 is disposed in bore 196 of locking element 191 with one end supported by annular shoulder 198 and the other end supported by annular shoulder 193. Locking element 191, with socket contact 21 and clip ring 67 mounted therein, is then snapped into the oblong cavity of female housing section 23 with hood 84 extending into bore 181 of casing 177 so that hood first end 88 generally abuts casing ridge 183. Clip ring 67 is sandwiched between annular shoulder 198 and 193.

Housing sections 23 and 26 can be slidably interconnected with each pin 31 protruding from male housing section second side 52 slidably received by a hood 84 of the corresponding socket contact 21 housed in casing 177 within female housing section 23.

Unlike similar socket contacts in the prior art, the opening formed by inner surface 103 of arc arresting member 92 has a diameter 106 which is smaller than diameter 36 of pin 31. As a result, pin 31 cannot enter bore 85 and contact conductive strip 121 (or the inside of the split hood described previously) without first engaging bevelled surface 108 and thereby establishing an electrical connection between the socket and pin contacts 21 and 27. Once pin 31 has made physical and electrical contact with bevelled surface 108, male housing section 26 with pin contact 27 therein must be forcibly further mated with female housing section 23 for pin 31 to further enter central bore 85 to make contact with crown member 121. The rounded configuration of pin end 38 and the conical configuration of surface 108 urge arc arresting member 92 to radially expand and enlarge as the pin is so inserted therein (FIG. 6). Split 117 and groove 118 in arc arresting member 92 permit this expansion to accommodate pin 31 passing therethrough.

Figure 8:
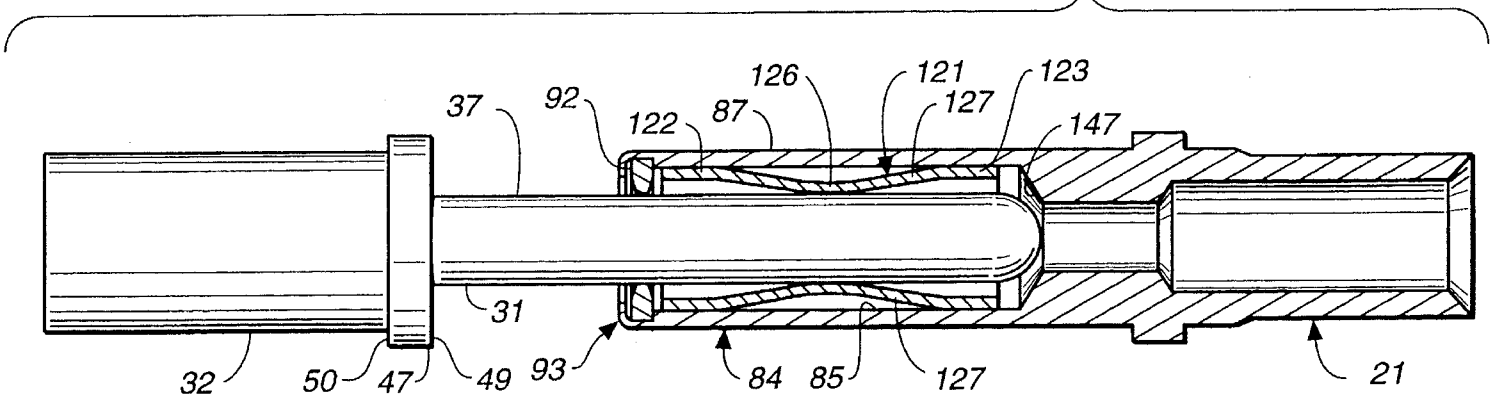
FIG. 8 is a partial sectional view of the pin contact shown in FIG. 7 completely inserted in the socket contact.

When pin contact 27 is fully engaged with socket contact 21, pin 31 being disposed in hood 84, raised cross members or contacts 127 forming part of crown band 121 engage pin outer surface 41 (FIG. 8). Cross members 127 and outer surface 41 serve as the main electrical connection between socket and pin contacts 21 and 27. Tapered portion 147 is dimensioned and configured to receive the end portion of pin 31 should the pin extend that far within socket contact 21.

As can be seen, the unique and novel configuration of socket contact 21 precludes deleterious electrical arcing, between pin contact 27 and thin conductive strip 121 (or the inside of a split hood) mounted within socket contact 21. This is made possible by the narrowed opening 103 which causes a mandatory engagement and a resulting electrical connection between pin and socket contacts 27 and 21 before pin 31 can enter hood 84. The forcible interaction of pin end 38 and bevelled surface 108 causes opening 103 to radially expand and enlarge for allowing pin 31 enter hood bore 85. Correspondingly, groove 118 expands with split 117 due to the reduction of material in groove 118. Only after an electrical connection has been established between the socket and pin contacts, eliminating the arc producing electrical potential difference between the contacts, does pin 31 approach conductive strip 121 (or the inside of the split hood discussed above).

End portion 158 can have other configurations for facilitating an electrical connection to socket contact 21 by an electrical source other than the crimp shown such as soldered, attached with a pig tail, etc. and be within the scope of the present invention as one of ordinary skill in the art will recognize.

It is apparent from the foregoing that a new and improved socket contact for use with a pin contact has been provided which restricts damaging arcing to a conductive contact element mounted in the socket contact. The socket contact has an arc arresting member with an opening smaller than the diameter of the contact pin for ensuring an electrical connection before the pin contact enters the socket contact. The opening is expandable to permit entry of the contact pin when forcibly inserted into the socket contact. The socket contact can be used with a variety of tail sections. While only certain presently preferred embodiments have been described in detail, as will be apparent to those familiar with the art, various variations, substitutions, changes, modifications and equivalents exist for various elements which do not materially depart from the spirit and scope of the invention. Accordingly, it is expressly intended that all such variations, substitutions, modifications, and equivalents can be made without departing from the scope of the invention as defined by the following claims.

The invention claimed is:

1. A socket contact for mating with a pin contact, said socket contact comprising:

a section for attaching to an electrical component;

a tubular section forming a bore for receiving the pin contact;

a conductive area around an inner wall of the bore and having a contact portion for contacting the pin contact; and an elastic expansion member located adjacent to a forward opening in the tubular section, the expansion member having an opening smaller than the outer diameter of the pin contact for initially engaging the pin contact and establishing an electrical connection between the pin contact and socket contact, through the elastic expansion member and then expanding resiliently so as to let the pin contact pass therethrough into the bore, whereby the initial engagement and resulting electrical connection between the pin contact and the expansion member precludes deleterious electrical arcing between the pin contact and the conductive area.

2. The socket contact of claim 1 wherein the tubular section further comprises an annular seat having a diameter greater than the diameter of the bore and being adjacent to the forward opening for receiving the expansion member.

3. The socket contact of claim 1 wherein the expansion member is a split ring.

4. The socket contact of claim 1 wherein the conductive area includes a strip of spring contacts of conductive material mounted substantially around the inner wall.

5. The socket contact of claim 4 wherein the contact portion comprises a plurality of spaced apart cross members with a centrally disposed segment along their length having a reduced diameter and being longitudinally aligned with an axis of the tubular section.

6. An electrical socket contact for mating with a pin contact in an electrical connector, said socket contact comprising:

an electrical component-attaching end;

a cylindrical section opposite of the electrical component-attaching end having a cavity therethrough for receiving the pin contact and an annular recess positioned adjacent to an opening into the cavity;

a generally cylindrical contact area located in the cavity with a segment having a reduced inner diameter for contacting the pin contact; and an arc arresting member seated in the annular recess, the arc arresting member having a segment with an inner diameter smaller than an outer diameter of the pin contact whereby when the pin contact is inserted through the opening into the cavity an electrical connection is made between the pin contact and the arc arresting member and the arc arresting member is forced to expand by the pin contact as the pin contact is inserted into the cavity of the cylindrical section.

7. The socket contact of claim 6 wherein the arc arresting member is a split collar.

* * * * *